US012145029B2

(12) United States Patent
Thomas et al.

(10) Patent No.: US 12,145,029 B2
(45) Date of Patent: Nov. 19, 2024

(54) HAND-HELD PICKLEBALL RETRIEVER FOR LIMITED MOBILITY PLAYERS

(71) Applicants: Jean Marie Thomas, Highlands Ranch, CO (US); Frederick G. Snook, Sr., Gaylord, MI (US)

(72) Inventors: Jean Marie Thomas, Highlands Ranch, CO (US); Frederick G. Snook, Sr., Gaylord, MI (US)

( * ) Notice: Subject to any disclaimer, the term of this patent is extended or adjusted under 35 U.S.C. 154(b) by 762 days.

(21) Appl. No.: 17/240,572

(22) Filed: Apr. 26, 2021

(65) Prior Publication Data

US 2021/0354006 A1 Nov. 18, 2021

Related U.S. Application Data

(60) Provisional application No. 63/023,743, filed on May 12, 2020.

(51) Int. Cl.
*A63B 47/02* (2006.01)

(52) U.S. Cl.
CPC ..... *A63B 47/02* (2013.01)

(58) Field of Classification Search
CPC . A63B 47/02; A63B 2102/08; A63B 2220/80; A63B 2220/805; A63B 2220/806; A63B 2220/808; A63B 2220/89; A63B 2225/15; A63B 2225/50
See application file for complete search history.

(56) References Cited

U.S. PATENT DOCUMENTS 3,819,049 A * 6/1974 Koerner ..... A63B 47/02 414/440
5,758,992 A * 6/1998 Sawallisch ..... A63B 47/025 406/171
6,834,776 B1 * 12/2004 Corvese ..... A63B 47/025 473/460
7,165,289 B1 * 1/2007 Gossage ..... B65G 53/24 15/314
8,313,396 B1 11/2012 Mailman
2019/0045989 A1 * 2/2019 Castaldi, III ..... A47L 9/12

FOREIGN PATENT DOCUMENTS

KR 20180018469 A * 12/2017

OTHER PUBLICATIONS

Masspickleballguide.com (https://masspickleballguide.com/equipment/ball/pickleball-ball-vs-tennis-ball/) (Year: 2024).*

* cited by examiner

*Primary Examiner* — Stephen A Vu
(74) *Attorney, Agent, or Firm* — Nutter McClennen & Fish LLP

(57) ABSTRACT

Embodiments described herein relate to methods, systems, and devices that can be leveraged to retrieve pickleballs from a court surface. More particularly, the present embodiments relate to a portable, light-weight, hand-held pickleball collector.

12 Claims, 11 Drawing Sheets

HAND-HELD PICKLEBALL RETRIEVER FOR LIMITED MOBILITY PLAYERS

CROSS-REFERENCE TO RELATED APPLICATION

This application is a non-provisional of and claims the benefit under 35 U.S.C. 119 (e) of U.S. Provisional Patent Application No. 63/023,743, filed May 12, 2020, the contents of which are incorporated herein by reference as if fully disclosed herein.

TECHNICAL FIELD

The described embodiments relate generally to a hand-held ball retrieval device. More particularly, the present embodiments relate to a portable, light-weight, hand-held pickleball collector.

BACKGROUND

Pickleball is a paddle sport, similar to tennis, that is played on a small court and utilizes light-weight, perforated plastic balls. Due to the smaller court and flight-restricted nature of the pickleballs, the sport is popular among persons with restricted mobility. As with other sports, players are often required to retrieve the pickleballs from the court surface, as well as other the areas surrounding and adjacent to the court.

However, some repeated movements required to retrieve pickleballs can present challenges to limited-mobility participants, because pickleballs move unpredictably from the wind, or because they have landed in difficult-to-reach locations, such as in bushes, and beneath trees, benches, or other obstructions.

SUMMARY

Embodiments described herein relate to a light-weight, hand-held, device used to retrieve pickleballs from a pickleball court.

Some embodiments described herein take the form of a hand-held apparatus for retrieving light-weight perforated spherical objects, such as pickleballs (also known as wiffle balls). The hand-held apparatus in such examples typically includes: a motor/impeller; a suction inlet having a first end coupled to the motor/impeller and configured to pneumatically retrieve the perforated spherical objects through a second end of the suction inlet; a collection diverter coupled to a lower side of the suction inlet forming a junction with an opening through which the perforated spherical objects pass; a storage container, for retaining the retrieved perforated spherical objects, positioned below (and, in some examples releasably coupled to) the collection diverter; and a vaned filter element positioned in the suction inlet above the collection diverter and configured to divert the perforated spherical objects from the suction inlet into the storage container.

The motor/impeller may be disposed in a housing or enclosure including and/or defining a handle; an actuator switch; and an electric motor configured to generate suction in the suction inlet. The storage container, in one embodiment, includes a flexible web which may be made from fibers (e.g., a plastic, a nylon, a polyester, a polyvinyl chloride, a metal, and so on). In embodiments, the perforated spherical objects comprise at least one of pickleballs, tennis balls, ping pong balls, golf balls, baseballs, or wiffle balls.

In some embodiments, the perforated spherical objects are pickleballs. In embodiments, the suction inlet and collection diverter are fabricated from a single piece of material. In embodiments, the suction inlet and collection diverter are fabricated from at least two pieces of material. In embodiments, the suction inlet and collection diverter are fabricated from polyvinyl chloride.

In some embodiments, a hand-held pickleball collector includes: a motor/impeller combination defining a motor/impeller opening; a storage container for holding retrieved balls; a suction inlet, including: a first tubing defining a first tubing external opening and a first tubing internal opening opposite the first tubing external opening; a junction defining: a first junction opening coupled to the first tubing internal opening; a second junction opening opposite the first junction opening; and a third junction opening positioned at a right angle to a line between the first junction opening and the second junction opening, the third junction opening coupled to the storage container; and a second tubing defining a second tubing first opening and a second tubing second opening opposite the second tubing first opening, the second tubing second opening coupled to the motor/impellor opening; the second tubing first opening coupled to the second junction opening; and a vaned filter element coupled to an inner upper surface of the junction and positioned above the storage container, the vaned filter element configured to direct the retrieved pickleballs into the storage container. In embodiments, the inner diameter of the tubular retriever portion is 3 inches. The storage container includes a flexible web; and at least one rigid circular frame portion positioned in the flexible web.

Further, in embodiments, the hand-held pickleball collector may include a collection attachment. The collection attachment may include a curved scooping attachment, or a flexible hose attachment. Further, the motor/impellor may include a power trigger switch with a continuously variable power control.

In some embodiments, a portable pickleball retriever includes a suction inlet comprising a first opening at a first end of the suction inlet; a motor/impeller coupled to and in pneumatic communication with a second opening in a second end of the suction inlet, the second opening opposite the first opening; a collection diverter positioned below and in pneumatic communication with a third opening in the suction inlet, the third opening positioned between the first opening and the second opening; a storage container attached to and in pneumatic communication with the collection diverter; and a vaned filter attached to an upper inside surface of the suction inlet and positioned above collection diverter.

In some embodiments, the coupling of the motor/impeller to the second opening is a rigid attachment. The motor/impeller may be a vacuum canister, and the coupling of the vacuum canister to the suction inlet may be with a flexible hose.

In some embodiments, the portable pickleball includes a ball stop coupled to an inner upper surface of the suction inlet and positioned between the first opening and the third opening.

In some embodiments, the portable pickleball includes a curved scooping attachment coupled to the first opening.

In embodiments, the portable pickleball includes an actuator sensor positioned within the suction inlet. The actuator sensor may disable the motor/impeller.

BRIEF DESCRIPTION OF THE DRAWINGS

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The use of the same or similar reference numerals in different figures indicates similar, related, or identical items.

Figure 1:
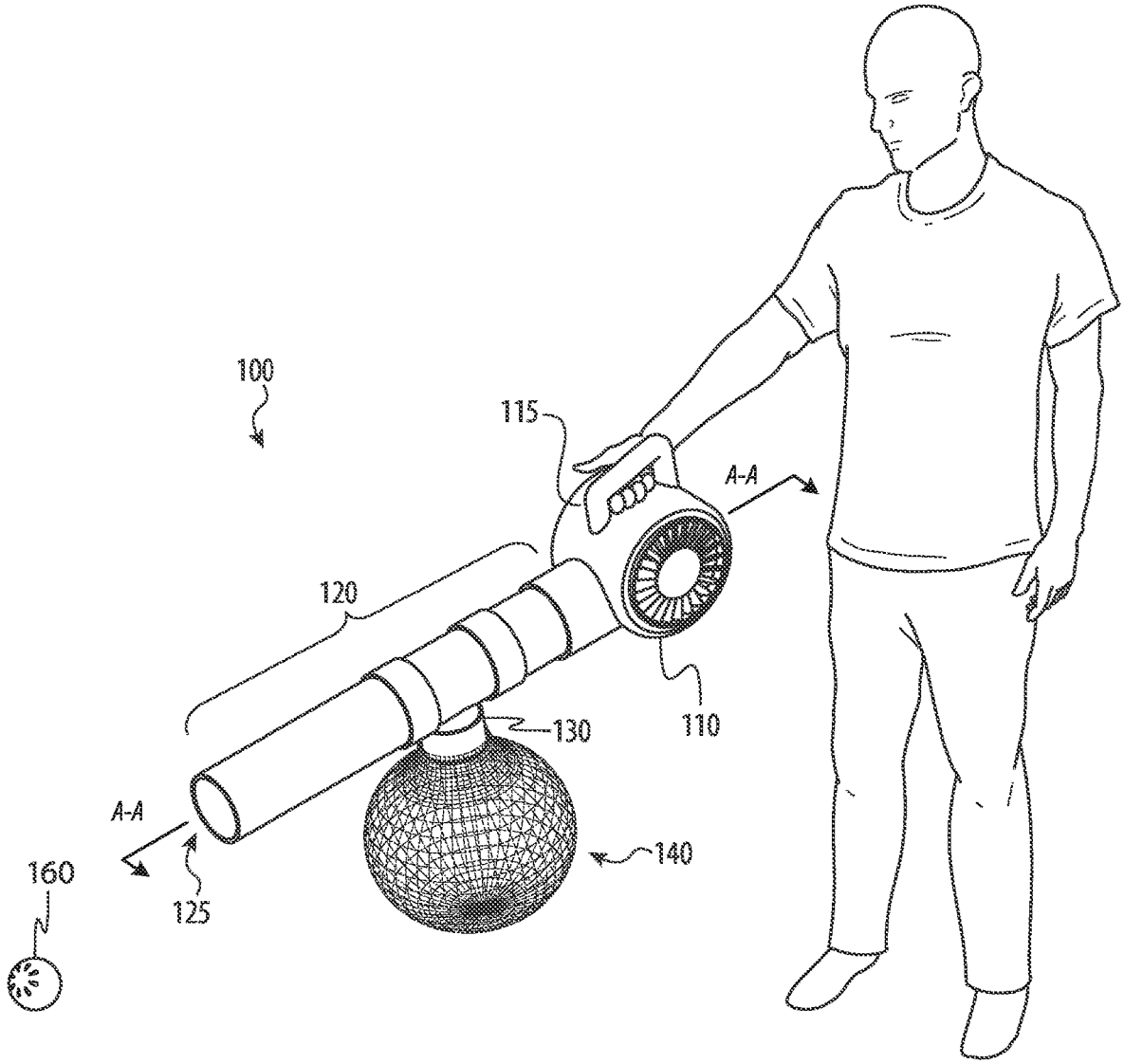
FIG. 1 illustrates a player interacting with a sample pickle ball collector showing components of a sample embodiment.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Embodiments described herein generally reference a hand-held ball collector and, in particular, portable, a lightweight, hand-held pickleball collector (herein, a "pickleball collector"). Constructions described herein leverage lightweight materials, power sources, and operational components specifically to reduce weight and increase convenience of use of the device for players of pickleball who may have limited mobility. As a result of these constructions, players of pickleball may conveniently retrieve scattered pickleballs quickly so that gameplay can begin again.

For example, as described herein, a pickleball collector as described herein may include at least a motor coupled to an impeller (a combination referred to herein as a "motor/impeller") in turn coupled to one end of a suction inlet, which in many examples is implemented as a cylindrical conduit sized to allow free passage of a pickleball therethrough. In some cases, the suction inlet may be tapered (e.g., having a greater diameter at one end than another), whereas in other cases, it may be a regular cylindrical pipe. In yet other examples, the suction inlet may have another cross-sectional shape, such as a triangular shape or a rectangular shape. For simplicity of description, the embodiments that follow reference a suction inlet defining a cylindrical shape and having a non-tapered longitudinal cross-section. It may be appreciated however that this is merely one example construction and that in other examples, a suction inlet can take other forms and/or may include other features or characteristics.

For embodiments described herein, the motor of the pickleball collector drives the impeller to generate a suction force that may be leveraged to collect balls from a surface through an opening at the other end of the suction inlet. The motor may be electrically driven or may be a combustion engine. For simplicity of description, the embodiments that follow reference an electrical motor, but it may be appreciated by a person of skill in the art that this is merely one example and that other constructions are possible.

In many examples, the motor/impeller may be selected and/or operated to (e.g., throttled) provide a sufficient suction force to retrieve pickleballs. As a result of these constructions, a pickleball collector as described herein may be intentionally insufficiently powerful to retrieve courtside debris or other sport equipment. Such throttled constructions may further leverage the advantage of lower operating noise, enabling a pickleball collector as described herein to be used in a public setting with multiple pickleball courts in a manner that does not disturb other players.

Regardless of implementation and/or configuration, it may be appreciated that generally and broadly a motor/impeller is used to generate a suction force at a suction inlet. The suction inlet may also have a collection diverter coupled to the suction inlet. The collector diverter may be a pathway, tubing, plenum space, or other conduit. As with the suction inlet, the collector diverter may have a cross-sectional area selected such that a pickleball can pass freely therethrough.

In typical constructions, the collection diverter may be attached to the suction inlet forming a junction. The pickleball collector may include a storage container attached to the collection diverter. Further, the pickleball collector may include a vaned filter coupled to the suction inlet, and positioned above the storage container and the collection diverter. The vaned filter redirects the pickleballs entering the suction inlet toward the motor/impeller down through the collection diverter into the storage container. The vaned filter can take any suitable shape although in many examples, it takes a shape that when impacted by a pickleball, rebounds the pickleball through the collection diverter into the storage container. Example shapes that the vaned filter may take include, but are not limited to a concave curved shape, an angled shape, a convex rounded shape, and so on.

As a result of this construction, when the motor/impeller is coupled to a power source, a player (or non-player user of the pickleball collector) may hold the pickleball collector in one hand (or may strap the pickleball collector via a shoulder strap or backpack) and walk around the pickleball court retrieving pickleballs from the court surface by vacuuming the pickleballs up through the open end of the suction inlet. The pickleballs are pneumatically pulled up the suction inlet, rebounded by the vaned filter, and diverted through the collection diverter into the storage container.

As noted above, the motor/impeller may be any suitable type and weight that may be carried by a player, especially a player having limited mobility and/or limited strength. The motor/impeller may be powered electricity. That is, the motor/impeller may be powered by batteries, or by a power cord plugged into an electrical outlet. For those pickleball collectors powered with a power cord, the power cord may include as a coiled cable. Batteries may be rechargeable. The pickleball collectors with rechargeable batteries may include a charging stand, and/or a wireless charging capability. The motor may have a noise abatement attachment, such as a housing, or other device that may reduce the sound of the motor.

The motor/impeller may be gasoline. That is the motor/impeller may be powered by either a two-stroke or a four-stroke engine. The engine may have a noise abatement attachment, such as a muffler.

In many examples, the suction inlet and collection diverter have the same diameter, although this may not be required of all implementations or constructions. They may be formed from one piece of material, or may be formed by joining two sections of suction inlet with a T-shaped section, or other junction. For example, in further embodiments, a junction may take another shape, whether with curved branches or otherwise.

The suction inlet and the collection diverter may be formed from the same material or from differing materials. Examples of materials that may be used to form the suction inlet and collection diverter include PVC, CPVC, polypropylene, polyethylene, PEX, polyurethane, silicone, santoprene.

The storage container may be formed from a flexible web, a net material, or cloth fabric. The flexible web and net material may be comprised of fibers made from one or more of plastic, nylon, polyester, polyvinyl chloride, or metal. The cloth fabric may be comprised of cotton, nylon, polyester, spandex, or any combination thereof.

In embodiments, the storage container may be formed of a rigid material. For example, the storage container may be fabricated from the same material as the suction inlet and the collection diverter. In embodiments, the storage container may be a tube of the same diameter as collection diverter, and may be coupled to the collection diverted similarly to how the suction diverter is coupled to the suction inlet. In embodiments, the storage container may be coupled to the collection diverter with a quick-release, or quick-connect connection.

In many embodiments, a pickleball collector as described herein can include one or more sensors to improve and simplify operation thereof. For example, in on embodiment, an optical sensor such as a proximity sensor, photointerrupter, or color sensor can be coupled to the suction inlet. In these examples, the sensor can be leveraged by the pickleball collector to automate a time at which the motor/impeller is actuated. For example, as the player moves the pickleball collector around a court, it may be powered down/not actuated unless and until the sensor determines that a pickleball is nearby or proximate to the suction inlet. In response to a signal from the sensor, the pickleball collector can actuate or energize the motor/impeller so that a suction force can retrieve the detected ball.

In still other examples, other sensors may be used. For example, a color sensor can be leveraged to sort pickleballs of different color into different storage containers.

In these and other examples, additional sensors may be leveraged to disable or de-energize a pickleball collector as described herein. For example, a sensor positioned within or adjacent to a junction, the collection diverter, the vaned filter, or the storage container can be used to disable the motor/impeller. In more simple terms, the motor/impeller can be actuated when a pickleball is detected and can be deactivated when that pickleball is received in the storage container.

In still further examples, one or more sensors may be used to count a number of pickleballs retrieved. These foregoing examples are not exhaustive of the number and type of sensors that can be coupled to a pickleball collector as described herein; it may be appreciated by a person of skill in the art that a number of suitable configurations are possible enabling a number of advanced features that can be leveraged by a player operating a pickleball collector as described herein. For example, sensors such as described herein can include: optical sensors; ultrasonic sensors; radar sensors; LIDAR sensors; magnetic field sensors; electrical field sensors; vibration sensors; impact sensors; switches; capacitive sensors; cameras; microphones; and so on. Uses of such sensors can include, without limitation: detecting proximity and/or presence of a pickleball nearby an input of the suction inlet; detecting proximity and/or presence of a pickleball nearby a collection diverter; detecting a color of a pickleball; detecting a characteristic acoustic signature of a pickleball as it passes through a component of a pickleball collector; detecting a color of a pickleball as it passes through a component of a pickleball collector; reading a barcode, text, serial number, or the like from a pickleball; detecting a wear state of a pickleball; detecting a manufacturer of a pickleball; reading an NFC or RFID tag of a pickleball and so on. Each example use of a sensor can enable a pickleball collector as described herein to, without limitation: enable suction by energizing the motor/impeller when a pickleball is detected nearby the inlet; disable suction by deenergizing the motor/impeller when a pickleball is detected within the storage container; enabling suction/collection only for pickleballs of particular color; enabling suction/collection only for pickleballs of a particular manufacturer; enabling suction/collection for pickleballs only within the boundaries of a particular court; disabling suction/collection upon determining that debris has entered the suction inlet; disabling suction/collection upon determining that the storage container is full; notifying a player or user of a location of a pickleball that may be collected (e.g., providing collection assistance to users with limited sight); providing a haptic or audio notification to a player/user upon determining that a pickleball has been successfully collected and is stored in the storage container; announcing or displaying a count of pickleballs collected in a certain time period or stored within the storage container; announcing or displaying one or more metadata properties of pickleballs stored in the storage container (e.g., three blue, one white, two Manufacturer X, two Manufacturer Y); and so on. The foregoing examples are not exhaustive; it may be appreciated that a sensor or suite of sensors may be leveraged by a pickleball collector as described herein for a number of suitable purposes.

For simplicity of description, many embodiments described below reference a simplified construction of a pickleball collector that optionally includes an optical sensor disposed to detect presence of a pickleball nearby a suction inlet. This sensor may be used to enable suction/collection as soon as a pickleball is detected, thereby increasing ease of use of the collector. It is appreciated, however, that this is merely one example and that in other embodiments and implementations, other sensors can be used.

These and some embodiments are discussed below with reference to FIGS. 1-7. However, those skilled in the art will readily appreciate that the detailed description given herein with respect to these figures is for explanatory purposes only and should not be construed as limiting.

FIG. 1 illustrates a player interacting with a sample pickleball collector showing components of a sample embodiment. The pickleball collector 100, also referred to more generally as the ball collector, includes a motor/impeller 110 with a handle 115. The motor/impeller 110 is coupled to one end of a suction inlet 120. The other end of the suction inlet has an opening 125. A collection diverter 130 is coupled to the suction inlet 120, and a storage container 140 is coupled to the suction inlet 120. A handle 115 is coupled to the motor/impeller 110.

The pickleball collector 100 may be used to pneumatically retrieve pickleballs 160. A player 170 may carry the pickleball collector 100 by the handle 115 and direct the opening 125 toward a pickleball 160 on the court surface. When the motor/impeller 110 is energized by activation of a trigger switch, pickleballs may be pneumatically pulled up the suction inlet 120, deflected into the collection diverter 130, and ultimately into the storage container 140.

Figure 2:
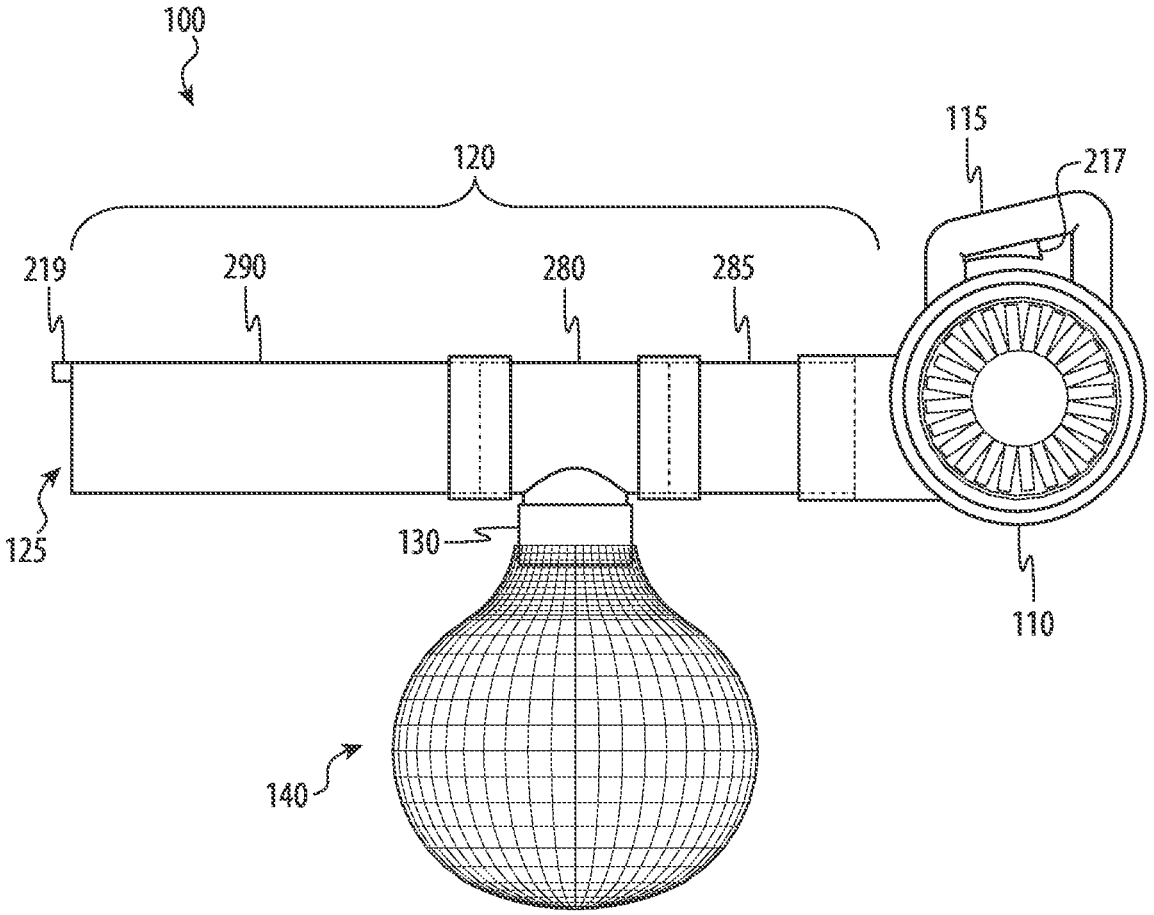
FIG. 2 is a pickle ball collector illustrating certain components of a sample embodiment.

An embodiment of the invention is provided in FIG. 2 showing a side view of pickleball collector 100. In the embodiment shown in FIG. 2, the combination of the suction inlet 120 and the collection diverter 130 is formed by removably attaching a junction 280 to first tubing 285 and second tubing 290. First tubing 285 pneumatically connects the motor/impeller 110 to the junction 280, and second tubing 290 pneumatically connects the junction 280 to the opening 125. The connections between the first tubing 285 and the motor/impeller 110, between the first tubing 285 and the junction 280, and between the junction 280 and the second tubing 290 may be by pressure fitting the tubing 285,290, the junction 280, and the motor/impeller 110 together.

In embodiments, the first tubing 285, the motor/impeller 110, the junction 280, and the second tubing 290 components may be removably coupled. In embodiments, the coupling may be made by a pressed friction fit, also known as an interference fit. That is, the components may be held together by the friction between tightly fit pieces that are pressed together. In embodiments, the coupling may be made by alternatively tapping and threading the components so that they may be screwed together. In embodiments, the pieces may be coupled by a keyed joint. That is, the coupling may be made by alternatively employing a key and an opening in the components being joined.

In embodiments, an adhesive and/or a sealant may be applied in the connections between the components, e.g., the first tubing 285, the motor/impeller 110, the junction 280, and the second tubing 290. The adhesive and/or a sealant may be applied in each of the couplings described above to increase the connection strength between the components.

The suction inlet 120 and collection diverter 130 may have the same inner diameter. In particular, the inner diameter of the suction inlet 120 and the collection diverter 130 of the pickleball collector, when it is used to retrieve pickleballs, is approximately 3 inches. In other embodiments, the inner diameters of the suction inlet 120 and the collection diverter 130 may be selected to optimally retrieve balls other than pickleballs.

The suction inlet 120 and the junction 280 may be formed from the same material or from differing materials. Examples of materials that may be used to form the suction inlet and collection diverter include PVC, CPVC, polypropylene, polyethylene, PEX, polyurethane, silicone, santoprene. In embodiments, the first tubing 285, second tubing 290, and the junction 280 may be made from different materials.

In embodiments, the combination of the suction inlet 120 and the collection diverter 130 may be formed from a single piece of material. Further, the combination of the suction inlet 120, the collection diverter 130, and the vaned filter 350 be formed from a single piece of molded material. By making the combination of the suction inlet 120, the collection diverter 130, and the vaned filter 350 out of a single piece of molded material, the pickleball collector 100 would have less material and weigh less, while having increased strength. The lower weight would improve the player experience by making the pickleball collector more easily handled by the player.

The motor/impeller 110 may have more than one mode of operation. That is, it may be possible to vary the power of the pickleball collector 100. In embodiments, the motor/impeller 110 may operate at a high-power suction mode. The motor/impeller 110 may operate at a low power suction mode. In embodiments, the motor/impeller 110 may have a variable power suction mode.

The power suction mode of the pickleball collector 100 may be controlled by the trigger switch 217. In embodiments, the trigger switch 217 may have discrete settings that allow the player to energize the motor/impeller 110 to several different settings, such as high, medium and low. In embodiments, the trigger switch 217 may have continuously variable power control, so that the player may be able to instantaneously vary the power suction mode of the pickleball collector with highly variable power control. In embodiments, the trigger switch may be spring loaded such that in the uncompressed state the motor/impeller is not energized.

In embodiments, the trigger switch 217 is located on the handle 115. In other embodiments, the trigger switch 217 may be located on the motor/impeller 110 housing away from the handle. Further, the trigger switch 217 may be located on a portion of the suction inlet 120.

In embodiments, the pickleball collector may have one or more sensors positioned in or on the suction inlet 120. For example, sensor 219 is positioned on second tubing 290 at the opening 125. In embodiments, sensor 219 may be a proximity sensor that would enable the motor/impeller 110, or other suction sources, to begin pneumatically propelling the pickleballs up the second tubing 290.

In embodiments, the sensor 219 may be a color sensor that would enable the motor/impeller 110, or other suction sources, on the basis of the color of the pickleball. In this way, the player may selectively retrieve balls of a given color.

In embodiments, the sensor 219 may be a sensor capable of distinguishing between balls and debris that might be on the playing surface. Thus, the sensor 219 would enable the motor/impeller 110, or other suction sources, on the basis of the whether the object sensed is a ball or is debris. In this way, the player may be able to retrieve balls that are in close proximity to debris without picking up the debris, as well.

In embodiments, the sensor 219 may be wirelessly linked to a remote station from where a user of the remote station might send signals to begin vacuuming the pickleballs up the second tubing 290.

Figure 3A:
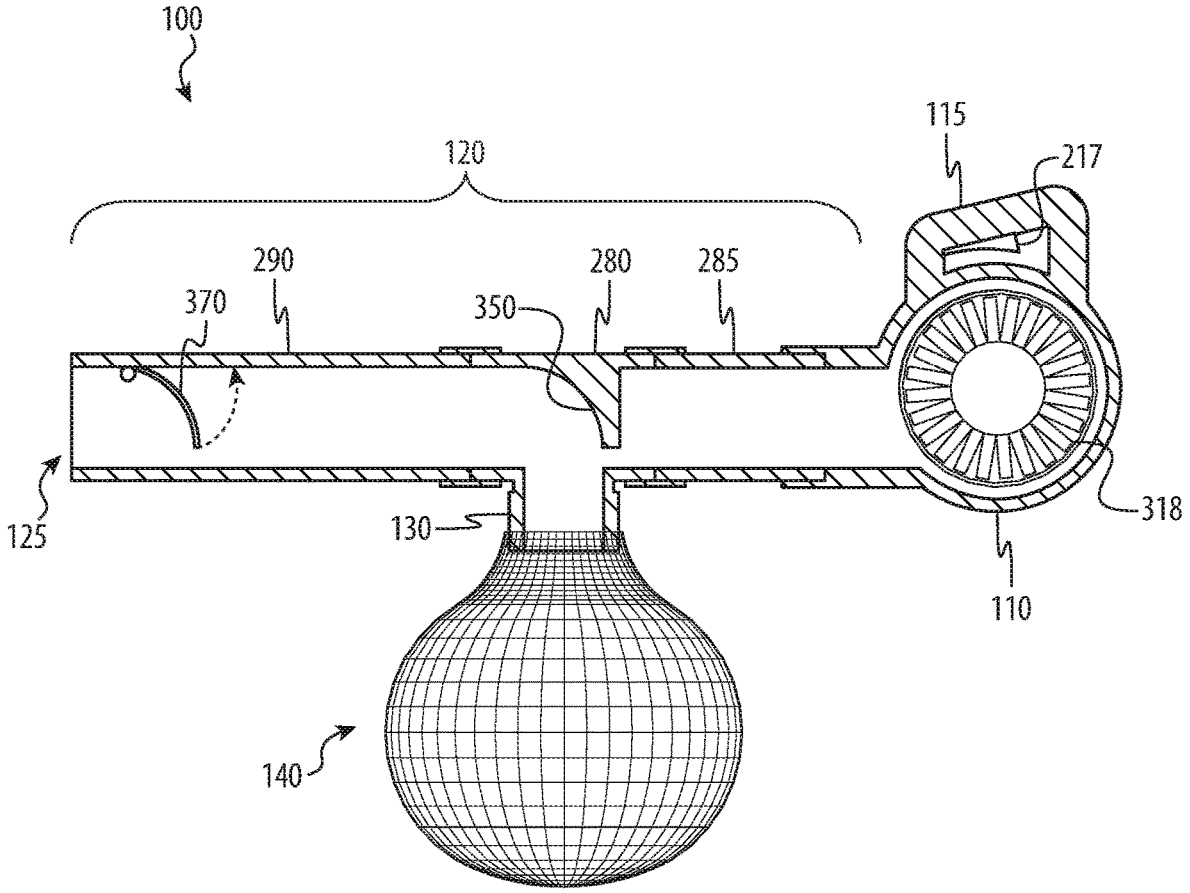
FIG. 3A is a section view of the pickleball collector in FIG. 2.

An embodiment of the invention is provided in FIG. 3A showing cross-section view A-A of a pickleball collector 100 from FIG. 1. The suction inlet 120 comprises a vaned filter 350 positioned above the collection diverter 130 and is molded as a part of the upper inner surface of the suction inlet 120. The vaned filter 350 redirects the pickleball that is being pneumatically propelled up the suction inlet 120 through the collection diverter 130 into the storage container 140.

In embodiments, the suction inlet comprises a ball stop 370. The ball stop 370 prevents pickleballs that are in the suction inlet 120 from rolling back out of the suction inlet 120 when the suction source is removed, e.g., when the motor/impeller 110 is turned off. The ball stop 370 may be positioned in the suction inlet 120 distal from the collection diverter. That is, the ball stop 370 may be positioned between the opening 125 and the collection diverter 130. The ball stop 370 allows a pickleball to be pneumatically propelled toward the collection diverter 130 by swinging out of the path of the pickleball toward the collection diverter, and then swinging back into place. The ball stop 370 is prevented from swinging toward the opening 125, thus preventing pickleballs from rolling out of the opening 125. In embodiments, the ball stop 370 may be made from one or more of plastic, nylon, polyester, polyvinyl chloride, or metal. The ball stop 370 may be formed as a wire, a solid, a web, and so on. The ball stop 370 may be spring loaded, or have a torsion bar, or other such mechanism that allows the ball stop 370 to be moved out of the way by the force of the pickleball being impelled by a suction force, but then spring back to its original position. In embodiments, the second tubing 290 may have an opening above the ball stop 370 that permits the ball stop 370 to rotate through the opening in the second tubing to provide clearance for the pickleball to pass under the ball stop 370 and the opening. The opening may be a slot that is only slightly wider than the width of the ball stop 370. In embodiments, the spring, or torsion bar, of the ball stop 370 may be positioned above the second tubing 290 with the ball stop 370 protruding down through a slot, or opening, in the top of the second tubing 290. In this arrangement, the ball stop 370 may be moved out of the second tubing 290 as the pickleball passes beneath the ball stop 370. That is, the ball stop 370 may protrude down through a slot in the second tubing 290 into the suction inlet 120 and may be operable to swing out through the slot in the second tubing when a pickleball is pneumatically impelled by suction toward the motor.

In embodiments, the pickleball collector may have a carry strap. The carry strap (e.g., shoulder strap, harness, and so on) may affixed to the motor/impeller 110 and/or the suction inlet 120.

In embodiments, the motor/impeller 110 may have a sound abatement attachment that reduces the noise of the motor/impeller 110.

The storage container 140 may be formed from a flexible web, a net material, or cloth fabric. The flexible web and net material may be comprised of fibers made from one or more of plastic, nylon, polyester, polyvinyl chloride, or metal. The cloth fabric may be comprised of cotton, nylon, polyester, spandex, or any combination thereof.

The storage container 140 is coupled to the collection diverter 130. In embodiments, the flexible web of the storage container may be coupled to the collection diverter 130 by using a clamp to encircle the opening in the flexible web to the storage container. In embodiments, storage container 140 may be secured to the collection diverter 130 with a string, a rope, an elastic band, or a wire.

In embodiments, the storage container is made of a rigid material (not shown). The rigid storage container may be a tube that has the same diameter as the suction inlet 120. The rigid storage container may couple to the collection diverter 130 similarly to how the suction inlet 120 couples to the collection diverter 130. In embodiments, the coupling mechanism between the collection diverter 130 and the rigid storage container may be a quick-release coupling mechanism. In embodiments, the rigid storage container may be used to store balls that have been collected for future use.

In embodiments, the pickleball collector 100 may be provided with a flexible conduit coupled to the collection diverter 130 in place of a storage container (not shown). The flexible conduit may be coupled to stationary storage container. The stationary storage container may be a box, a bag, a tube, a bucket, and so on.

Figure 3B:
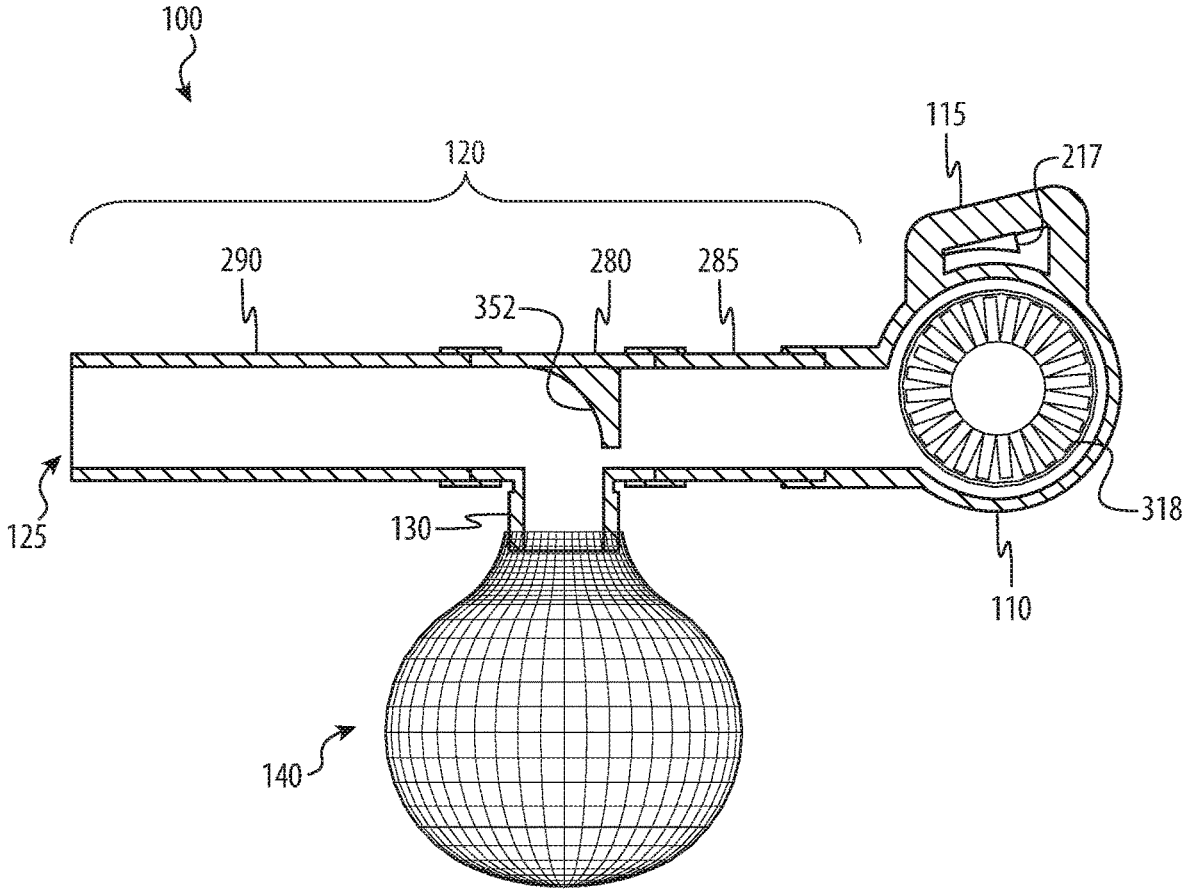
FIG. 3B is a section view of the pickleball collector in FIG. 2.

Another embodiment of the invention is provided in FIG. 3B showing cross-section view A-A of a pickleball collector 100 from FIG. 1. In this embodiment, the vaned filter element 352 is a separate element that is attached to an upper, inner surface of the junction 280 above the collection diverter 130. The vaned filter element 352 may be fabricated from the same material as the junction 280, or it may be a different material.

Figure 3C:
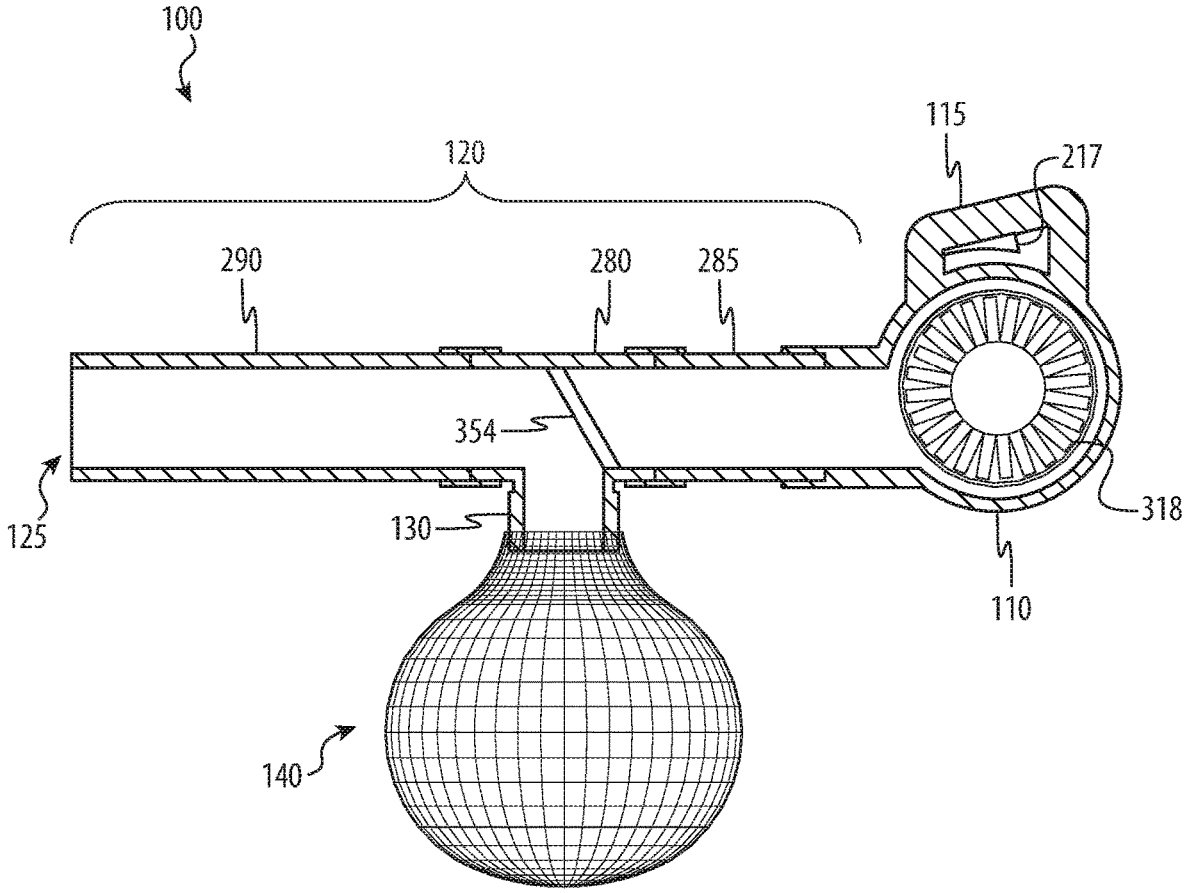
FIG. 3C is a section view of the pickleball collector in FIG. 2.

Another embodiment of the invention is provided in FIG. 3C showing cross-section view A-A of a pickleball collector 100 from FIG. 1. In this embodiment, the filter element 354 is a large format object mesh screen filter that is attached at one end to an upper, inner surface of the junction 280 above the collection diverter 130, and is attached at the other end to first tubing 285. The mesh screen of filter element 354 may have a grid with spacing's between 5 mm and 25 cm. The size of the filter grid spacing may be tailored to optimize the tradeoff between filtering efficiency and suction power.

Figure 3D:
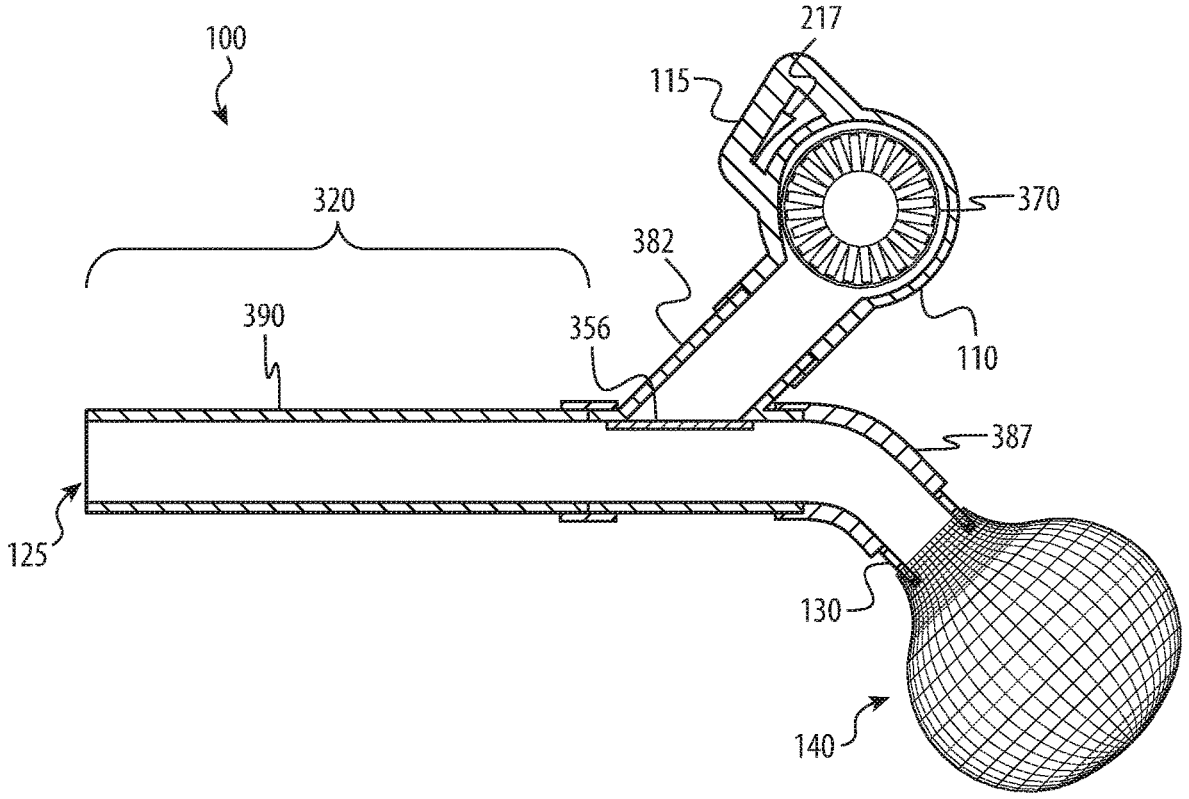
FIG. 3D illustrates an embodiment of a pickleball collector.

Another embodiment of the invention is provided in FIG. 3D showing a cross section view of a pickleball collector. In this embodiment, a suction inlet 320 includes a first tubing 390 that is removably attached to an angled junction 382. First tubing 390 pneumatically connects the opening 125 to the angled junction 382, and the angled junction 382 pneumatically connects to a curved tubing 387. The angled junction 382 pneumatically connects the motor/impeller 110 to the suction inlet 320, and pneumatically connects the motor/impeller 110 to the curved tube 387. The collection diverter 130 pneumatically connects the curved tubing 387 to the storage container 140.

The connections between the first tubing 390 and the angled junction 382, between the angled junction 382 and the motor/impeller 110, and between the angled junction 382 and the curved tubing 387 may be by pressure fitting the first tubing 390, the angled junction 382, the curved tubing 387, and the motor/impeller 110 together.

In the embodiment illustrated in FIG. 3D, an angled junction filter 356 is positioned over an opening of the angled junction 382, opposite the motor/impeller 110, and is attached to the angled junction 382. The angled junction filter 356 diverts the pickleball from being sucked up the angled junction 382 to the motor/impeller 110, and allows the pickleball that is being pneumatically propelled up the suction inlet 320 to travel through the angled junction 382, the curved tube 387, and the collection diverter 130 into the storage container 140.

The angled junction filter 356 may be a bar, a rod, a mesh screen filter, and so on. The size and shape of the angled junction filter 356 may be tailored to optimize the tradeoff between filtering efficiency and suction power. The angled junction filter 356 may be comprised of one or more of plastic, nylon, polyester, polyvinyl chloride, or metal.

In embodiments, the motor/impeller of the pickleball collector may be replaced by a vacuum canister (not shown).

The vacuum canister is a light-weight evacuated container that may provide the vacuum suction force to the suction inlet. The vacuum canister may be coupled to the suction inlet similarly to how the motor/impeller is coupled to the suction inlet. The vacuum canister may be coupled to the suction inlet with a flexible hose. The vacuum canister may have a handle that is attached to the vacuum canister, or is formed as one piece with the vacuum canister. The vacuum canister may have a valve for allowing air from the suction inlet to rush into the vacuum canister, thereby creating the impelling suction force. The vacuum canister may be evacuated in a separate process in preparation for attachment to the suction inlet. The vacuum canister has the advantage of being very light, because it does not have a motor, a fan, or any related electronics. The light-weight characteristics of the pickleball collector with the vacuum canister is advantageous to the limited-mobility player.

In embodiments, a vacuum canister may be combined with a low-power motor/impeller 110. The vacuum canister may provide on-demand additional power when required by the player. The vacuum canister may be coupled to the first tubing 285 distally away from the motor/impeller 110. In embodiments the motor/impeller is a vacuum canister.

Figure 4A:
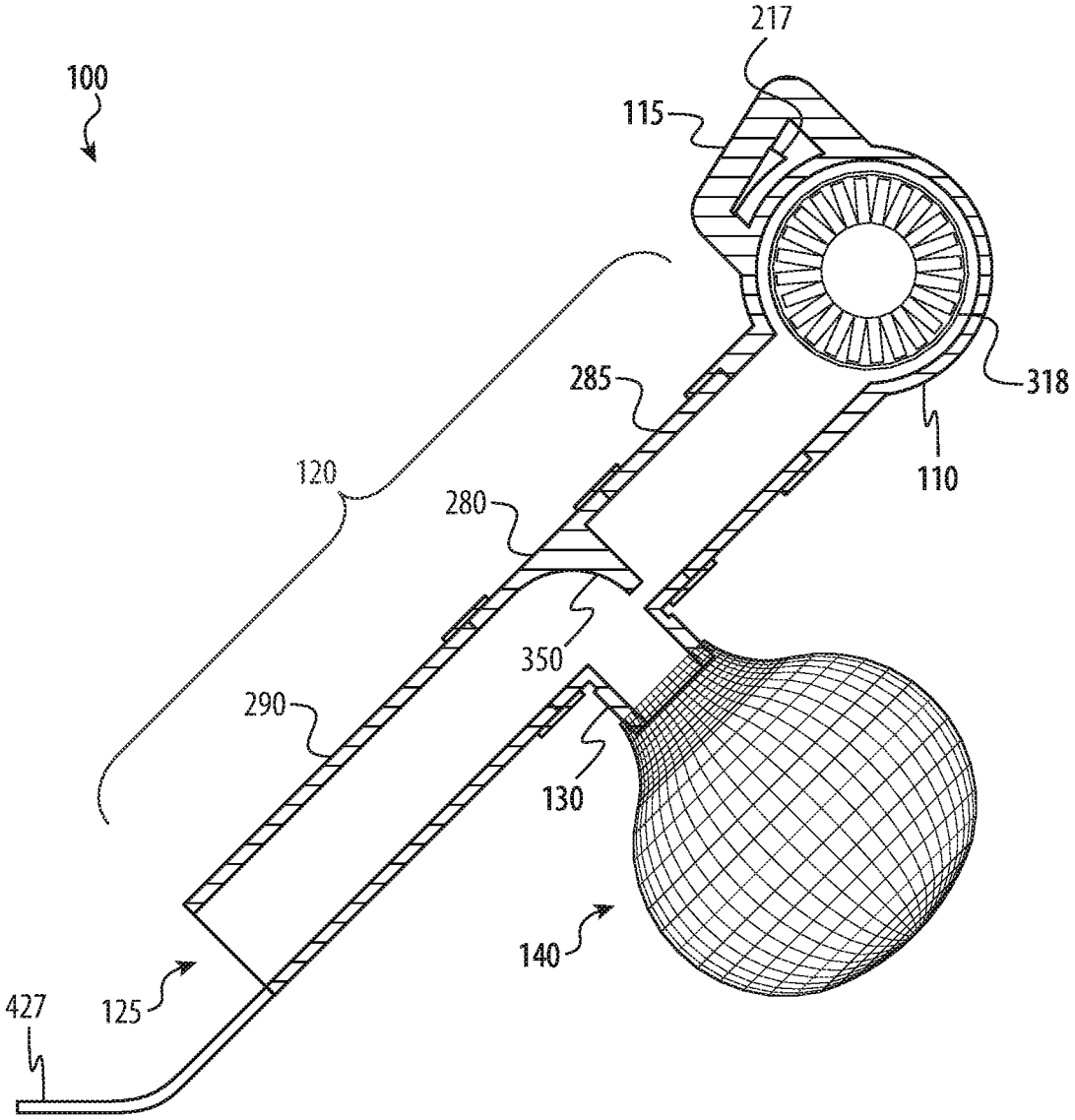
FIG. 4A illustrates an embodiment of a collection attachment coupled to the suction inlet.

In embodiments, collection attachments may be added to the suction inlet 120. For example, FIG. 4A illustrates an embodiment of the pickleball collector with a curved scooping attachment 427 that is coupled to the distal end of the second tubing 290 at the opening 125. The curved scooping attachment 427 may be removably attached to the second tubing 290 with a strap, a band, mechanical connectors, and so on. The curved scooping attachment may be fabricated from a flexible material, such as plastic, nylon, polyester, and so on. The curved scooping attachment 427 simplifies ball collection for players with limited mobility.

Figure 4B:
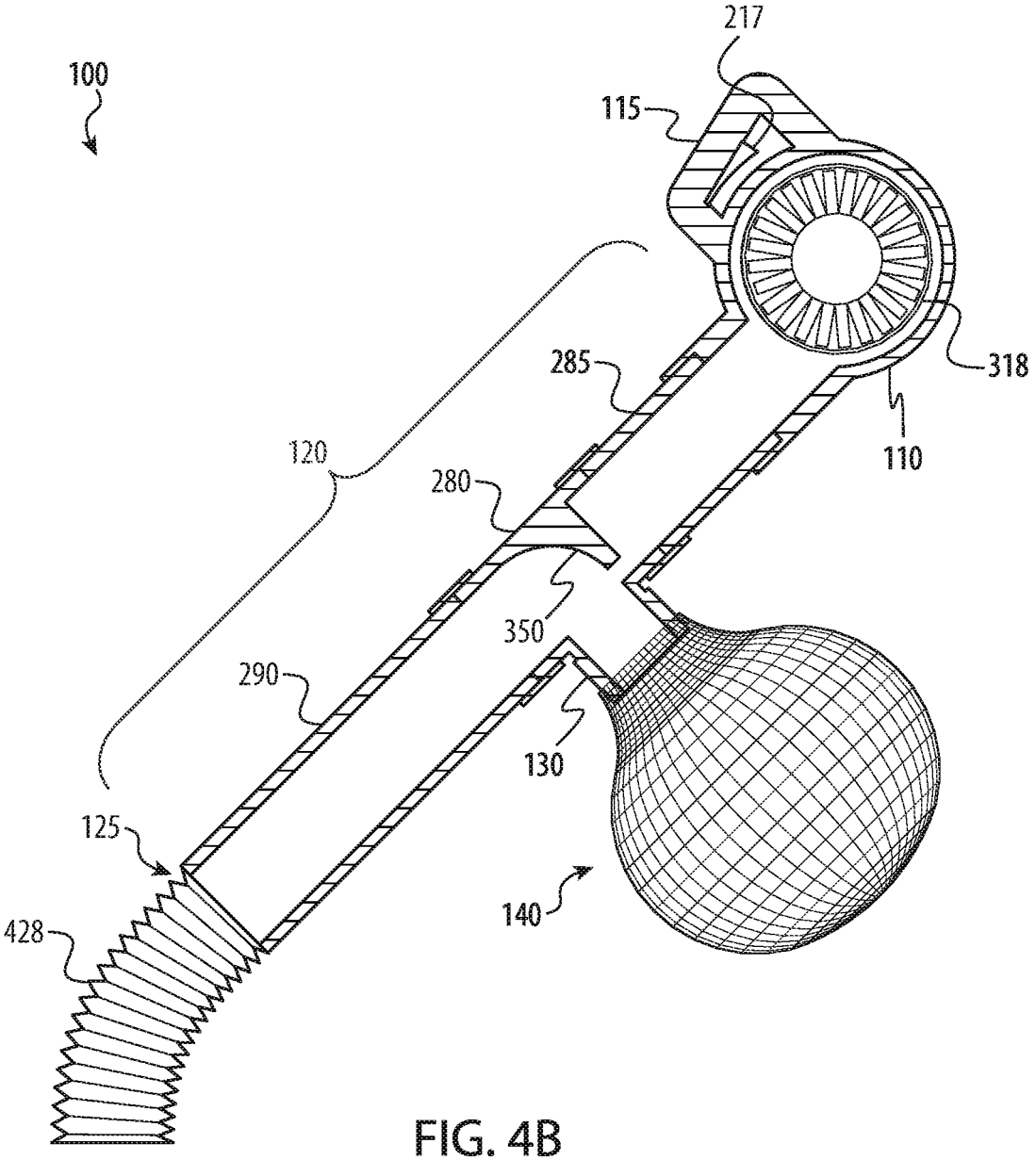
FIG. 4B illustrates an embodiment of a collection attachment coupled to the suction inlet.

In embodiments, the collection attachment may be a flexible hose attachment. FIG. 4B illustrates an embodiment of the pickleball collector with a flexible hose attachment 428 that is coupled to the distal end of the second tubing 290 at the opening 125. The flexible hose attachment 428 may be removably attached to the second tubing 290 with a strap, a band mechanical connector, and so on. The flexible hose attachment 428 may have the same diameter as the second tubing 290 and the opening 125. In embodiments, the flexible hose attachment 428 may have a smaller diameter than the second tubing 290 and the opening 125, or a larger diameter than the second tubing 290 and the opening 125. The flexible hose attachment 428 may increase the ease of use of the pickleball collector 100 by reducing the amount that the player must bend over while using the pickleball collector 100.

In embodiments, the collection attachment may be a rigid attachment (not shown). The rigid attachment may be an angled tubing attachment that is coupled to the distal end of the second tubing 290 at the opening 125. The angled attachment may be removably attached to the second tubing 290 with a strap, a band mechanical connector, and so on. The angled tubing attachment may have the same diameter as the second tubing 290 and the opening 125. In embodiments, the angled tubing attachment may have a smaller diameter than the second tubing 290 and the opening 125, or a larger diameter than the second tubing 290 and the opening 125. The angled tubing attachment may increase the ease of use of the pickleball collector 100 by reducing the amount that the player must bend over while using the pickleball collector 100.

In embodiments, the second tubing may be a flexible hose (not shown). The flexible second tubing has an opening at the distal end, and the proximal end may be removably coupled to the distal end of a junction with a strap, a band, mechanical connectors, and so on. The flexible second tubing may be fabricated from a flexible material, such as plastic, nylon, polyester, and so on. The flexible second tubing may increase the ease ball collection for players with limited mobility.

Figure 5:
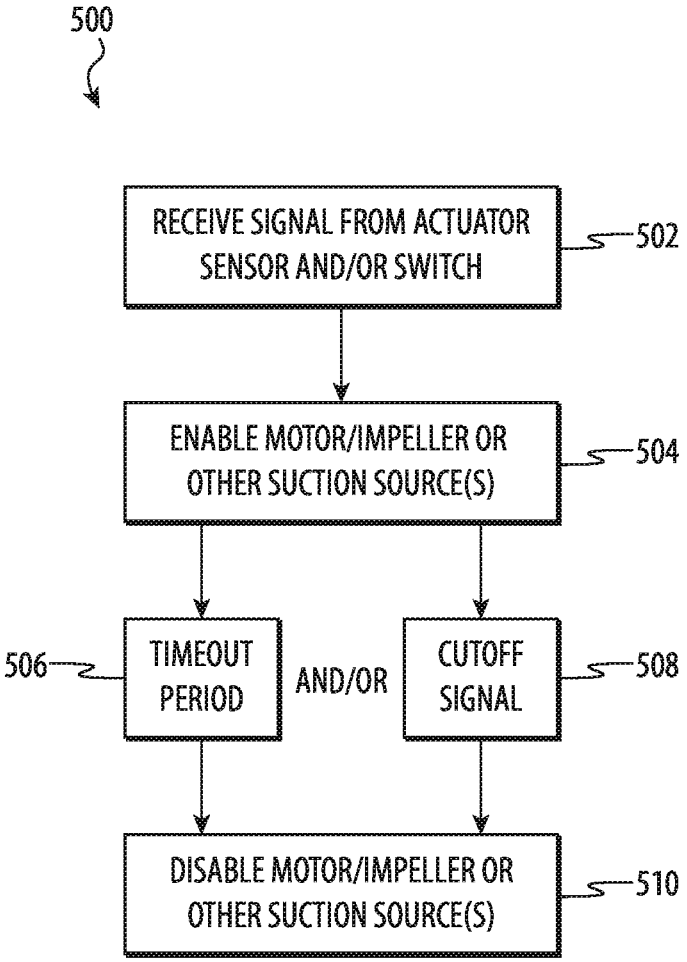
FIG. 5 is a flow diagram of a sensor-initiated process to retrieve balls according to one embodiment.

In embodiments, the operation of the motor/impeller may be enabled by a sensor and disabled by a timeout or by a cutoff signal. FIG. 5 is a flow diagram of such an embodiment of a sensor-initiated process 500 to retrieve the pickleballs. The sensor-initiated process 500 is well suited to be used by players of limited mobility, diminished eyesight, and weakened hand strength.

The sensor-initiated process 500 initially receives a signal from an actuator sensor and/or switch 502 when a ball is sensed. The actuator sensor, such as sensor 219, may be a proximity sensor, a color sensor, or some other type of sensor. An actuator switch (not shown) may be located at or around the opening 125. An actuator switch would be triggered by contact with a ball.

The signal received from the actuator sensor and/or switch enables the motor/impeller or other suction source(s) 504 to begin providing suction power to the suction inlet. As described above, motor/impeller 110 may operate independently, or may be supplemented by a vacuum canister. Further, in embodiments, a vacuum canister may be used by itself.

After passage of a timeout period 506, e.g., a predetermined period of time without sensing a ball, the motor/impeller or other suction devices are disabled 510. The duration of the timeout period is predetermined, and may be between 1 second and 20 seconds following receiving the signal from the actuator and/or switch 502.

Alternatively, a cutoff signal 508 may be received to disable the motor/impeller or other suction devices 510. The cutoff signal 508 may be provided by a player that is retrieving the pickleballs, or wirelessly from a remote source.

Figure 6:
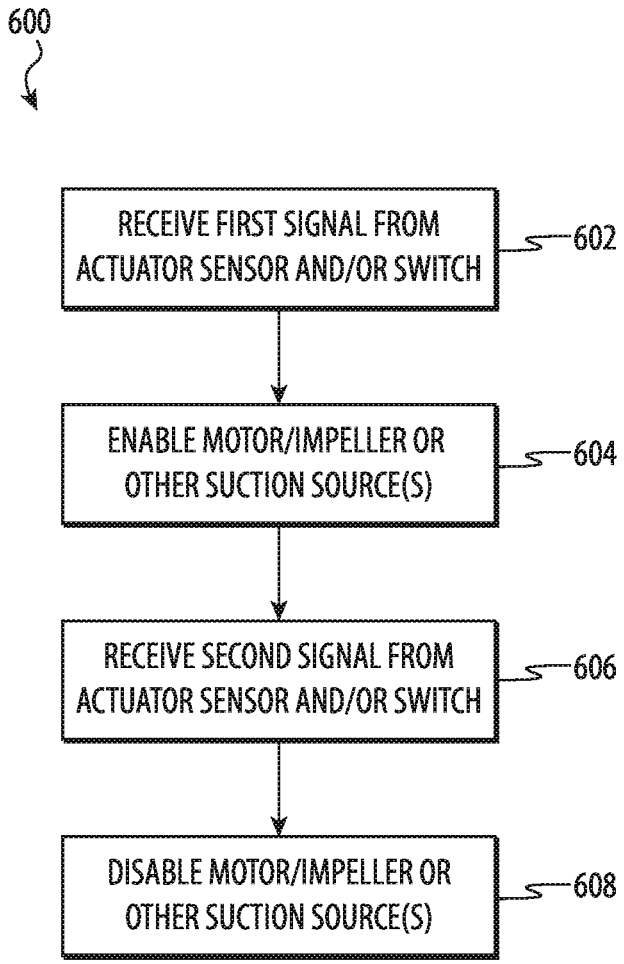
FIG. 6 is a flow diagram of a sensor-controlled process to retrieve balls according to one embodiment.

In another embodiment, a sensor-controlled process is initiated and ended by a sensor or switch. FIG. 6 is a flow diagram of such an embodiment of a sensor-controlled process 600 to retrieve balls. The sensor-controlled process 600 initially receives a first signal from an actuator sensor and/or a switch 602. The actuator sensor, such as sensor 219, may be a proximity sensor, a color sensor, or some other type of sensor. An actuator switch (not shown) may be located at or around the opening 125.

The signal received from the actuator sensor and/or switch enables the motor/impeller or other suction source(s) 604 to begin providing suction power to the suction inlet. As described above, motor/impeller 110 may operate independently, or may be supplemented by a vacuum canister. Further, in embodiments, a vacuum canister may be used by itself.

A second signal is received from the actuator sensor and/or switch 606. Depending on the actual type of sensor in use, the second signal may be based on a proximity sensor failing to detect any more balls within the proximity of the sensor, or a color sensor failing to detect any balls of the predetermined color. After receipt of the second signal 606, the motor/impeller or other suction sources is disabled 608.

The pickleball collector may have more than one diverter paths. A single diverter path includes a collection diverter, and a storage container. In this embodiment, the pickleball collector may have at least two diverter paths positioned along the bottom of the suction inlet. Further, a vaned filter is movable along the top inside surface of the suction inlet to divert an object being pneumatically impelled along the suction inlet. The vaned filter may be attached to a servo motor that quickly moves the vaned filter between the diverter paths.

Figure 7:
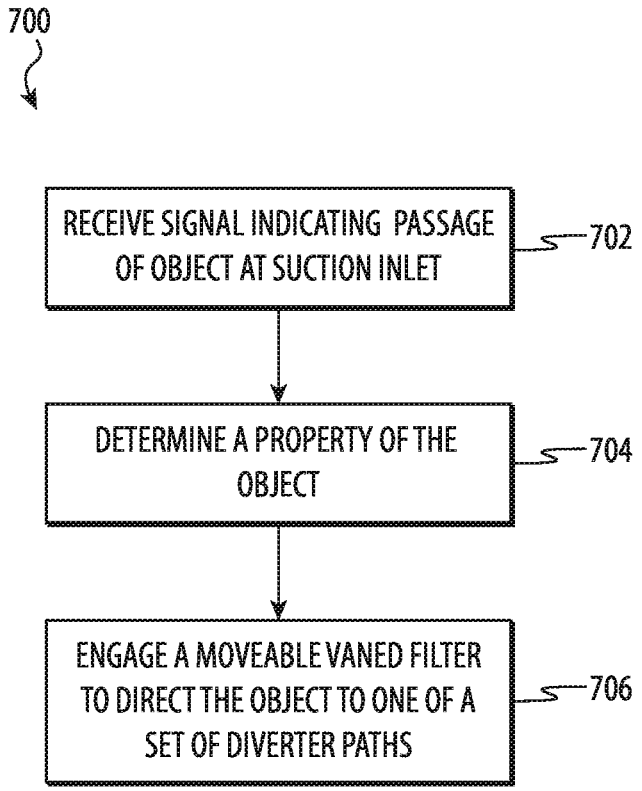
FIG. 7 is a flow diagram of a process of sorting retrieved objects with different properties according to one embodiment.

FIG. 7 is a flow diagram for a process of sorting retrieved objects with different properties, and directing each object to one of a set of diverter paths. The sorting process 700 is initiated by receiving a signal indicating passage of an object at the suction inlet 702. The signal may be sent by a sensor and/or a switch. In an embodiment, the sensor may differentiate between different sizes of balls. In another embodiment, the sensor may differentiate between different colors of balls. In another embodiment, the sensor my differentiate between a ball and debris.

Following receiving a signal indicating passage of an object at the suction inlet, the next step is to determine a property of the object 704. As described above, the determination of a property of the object may be based on the difference between the sizes of balls, the colors of balls, or even the difference between a ball and debris.

Following the determination of a property of the object 704, the next step will be to engage a moveable vaned filter to direct the object to one of a set of diverter paths 706. The vaned filter may be moved along a top inside surface of the suction inlet. Once an object is directed to one of a set of diverter paths, it will be collected in a storage container. The storage container may be a flexible net, or may be rigid.

In embodiments, the pickleball collector may have more than one filter element positioned in the suction inlet that would selectively divert different retrieved objects into one of a set of diverter paths. For example, in an exemplary embodiment, a given pickleball collector may be predetermined to retrieve pickleballs, ping pong balls, and debris. The objects may be filtered by size, with the pickleballs being diverted by the smallest filter element into a first diverter path, the ping pong balls being diverted by a larger filter element into a second diverter path, and the debris being diverted by a mesh filter element into a third diverter path.

The motor/impeller may be powered by batteries, or by a power cord plugged into an electrical outlet. For those pickleball collectors powered with a power cord, the pickleball collector may include a coiled cable.

In embodiments where the motor/impeller is powered by batteries, the batteries may be rechargeable. Further, the pickleball collector may include a charging stand that can charge the batteries wirelessly. In embodiments, the charging stand may provide wired charging when the stand is plugged into a power outlet.

As used herein, the phrase "at least one of" preceding a series of items, with the term "and" or "or" to separate any of the items, modifies the list as a whole, rather than each member of the list. The phrase "at least one of" does not require selection of at least one of each item listed; rather, the phrase allows a meaning that includes at a minimum one of any of the items, and/or at a minimum one of any combination of the items, and/or at a minimum one of each of the items. By way of example, the phrases "at least one of A, B, and C" or "at least one of A, B, or C" each refer to only A, only B, or only C; any combination of A, B, and C; and/or one or more of each of A, B, and C. Similarly, it may be appreciated that an order of elements presented for a conjunctive or disjunctive list provided herein should not be construed as limiting the disclosure to only that order provided.

One may appreciate that although many embodiments are disclosed above, that the operations and steps presented with respect to methods and techniques described herein are meant as exemplary and accordingly are not exhaustive. One may further appreciate that alternate step order or fewer or additional operations may be required or desired for particular embodiments.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the some embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

What is claimed is:

1. A hand-held pickleball collector for retrieving pickleballs from a surface, comprising: a motor defining a motor opening and comprising:

a handle;

an actuator switch; and an electric motor configured to generate suction;

a storage container for holding retrieved pickleballs, the storage container comprises a flexible web;

a suction inlet having an inner diameter of at least 3 inches and comprising:

a first tubing defining a first tubing external opening and a first tubing internal opening opposite the first tubing external opening;

a junction defining:

a first junction opening coupled to the first tubing internal opening;

a second junction opening opposite the first junction opening; and a third junction opening positioned at a right angle to a line between the first junction opening and the second junction opening, the third junction opening coupled to the storage container; and a second tubing defining a second tubing first opening and a second tubing second opening opposite the second tubing first opening, the second tubing second opening coupled to the motor opening, the second tubing first opening coupled to the second junction opening, the electric motor generating suction in the suction inlet;

a vaned filter element coupled to an inner upper surface of the junction and positioned above the storage container, the vaned filter element configured to direct the retrieved pickleballs into the storage container; and a ball stop coupled to the first tubing and positioned between the first tubing external opening and the first junction opening.

2. The hand-held pickleball collector of claim 1, wherein:

the inner diameter of the suction inlet is 3 inches;

the ball stop is coupled to the inner upper surface of the first tubing; and the storage container further comprises:

at least one rigid circular frame portion positioned in the flexible web.

3. The hand-held pickleball collector of claim 1 further comprises a collection attachment.

4. The hand-held pickleball collector of claim 3, wherein the collection attachment comprises a curved scooping attachment, or a flexible hose attachment.

5. The hand-held pickleball collector of claim 1, wherein the motor further comprises a power trigger switch with a continuously variable power control.

6. A portable pickleball retriever comprising:

a suction inlet comprising a first opening at a first end of the suction inlet;

a motor coupled to and in pneumatic communication with a second opening in a second end of the suction inlet, the second opening opposite the first opening;

a collection diverter positioned below and in pneumatic communication with a third opening in the suction inlet, the third opening positioned between the first opening and the second opening;

a storage container attached to and in pneumatic communication with the collection diverter; and a vaned filter attached to an upper inside surface of the suction inlet and positioned above the collection diverter.

7. The portable pickleball retriever of claim 6, wherein the coupling of the motor to the second opening is a rigid attachment.

8. The portable pickleball retriever of claim 6 wherein;

the motor is a vacuum canister; and the coupling of the vacuum canister to the suction inlet is with a flexible hose.

9. The portable pickleball retriever of claim 6, wherein the portable pickleball retriever further comprises:

a ball stop coupled to an upper outer surface of the suction inlet and positioned between the first opening and the vaned filter, the ball stop protrudes down through a slot in the suction inlet and is operable to swing out through the slot in the suction inlet when a pickleball is pneumatically impelled by suction toward the motor.

10. The portable pickleball retriever of claim 6, wherein the portable pickleball retriever further comprises:

a curved scooping attachment coupled to the first opening.

11. The portable pickleball retriever of claim 6, wherein the portable pickleball retriever further comprises:

an actuator sensor positioned within the suction inlet.

12. The portable pickleball retriever of claim 11, wherein the actuator sensor may disable the motor.

* * * * *